United States Patent [19]

Nehring

[11] Patent Number: 4,662,829

[45] Date of Patent: May 5, 1987

[54] PULSATILE PUMP

[75] Inventor: John R. Nehring, East Greenwich, R.I.

[73] Assignee: C. R. Bard, Inc., Murray Hill, N.J.

[21] Appl. No.: 587,250

[22] Filed: Mar. 7, 1984

Related U.S. Application Data

[63] Continuation-in-part of Ser. No. 568,356, Jan. 5, 1984, abandoned, which is a continuation of Ser. No. 297,728, Aug. 21, 1981, abandoned.

[51] Int. Cl.[4] ..... F04B 43/06

[52] U.S. Cl. ..... 417/395; 604/153

[58] Field of Search ..... 251/10; 417/394, 395; 604/153, 411, 414, 415

[56] References Cited

U.S. PATENT DOCUMENTS

| | | | |
|---|---|---|---|
| 2,847,007 | 8/1958 | Fox | 604/415 X |
| 3,039,272 | 6/1962 | Frick | 417/395 X |
| 3,048,121 | 8/1962 | Sheesley | 417/394 |
| 3,070,089 | 12/1962 | Dick | 417/478 |
| 3,263,618 | 8/1966 | Carpenter | 417/395 |
| 3,601,164 | 8/1971 | Bruce | 417/401 X |
| 3,635,607 | 1/1972 | Grise | 417/394 |
| 4,250,872 | 2/1981 | Tamari | 417/394 X |
| 4,346,869 | 8/1982 | Macneill | 251/10 |
| 4,350,477 | 9/1982 | Mazal | 417/384 |
| 4,449,827 | 5/1984 | Karkiewicz | 417/536 |

FOREIGN PATENT DOCUMENTS

| | | | |
|---|---|---|---|
| 1325670 | 3/1963 | France | 417/395 |

*Primary Examiner*—Leonard E. Smith

*Attorney, Agent, or Firm*—Wolf, Greenfield & Sacks

[57] ABSTRACT

A two-stroke pumping device for developing pulsatile fluid flow includes a housing with an internal resilient flexible element. The flexible element defines a pair of chambers within the housing, including a pumping chamber and a driving chamber. The pumping chamber is connected to a source of the fluid to be pumped and the driving chamber is connected to a pneumatic source adapted to create a pressure differential across the flexible element. The device includes a means responsive to the flexure of the element in one of the strokes to terminate that stroke and begin the other stroke. The flexible element oscillates to generate repetitive ejection and filling strokes. The pneumatic source may be a source of negative or positive pressure.

9 Claims, 17 Drawing Figures

PULSATILE PUMP

RELATED APPLICATIONS

This application is a continuation-in-part of my prior applications Ser. No. 568,356 filed Jan. 5, 1984 entitled VACUUM DRIVEN PULSATILE PUMP, now abandoned, which was a continuation of my prior application Ser. No. 297,728 filed Aug. 21, 1981 entitled VACUUM DRIVEN PULSATILE PUMP, now abandoned.

BACKGROUND AND SUMMARY OF THE INVENTION

This invention relates to fluid flow systems, particularly to devices used in such systems to cause fluid to be pumped in a pulsatile manner. The invention is useful particularly, although not exclusively, in medical environments, such as in operating rooms, where sources of positive and vacuum pressure sources are readily available.

Various devices for causing pulsatile fluid flow have been known and have found increasing use in a variety of environments including medical and dental environments. Pulsating fluid jets are effective to remove surgical debris from a surgical site. The use of pulsating fluid jets has been demonstrated to be a very effective way of cleaning wounds or applying antibiotics, disinfectants and the like. The effectiveness of the pulsating fluid technique is the result of the repeated flexure of tissue and/or repeated dynamic impact from the pulsations which tend to materially assist in working loose of dirt particles and other debris. They are useful in orthopedic surgical procedures to clear away bone chips.

Pulsating water flow devices also have been available for some time for use in connection with dental and oral hygiene and maintenance to remove food particles from difficult to reach crevices as well as to stimulate gums and oral tissue.

In addition to use of pulsating jets, some medical and operating room techniques call for low flow, more gentle pulsatile or peristaltic pumps. For example, they can be used to draw fluids from closed wounds and to deliver the fluids to a storage receptacle. They may be used as stomach pumps. Such a device may be used to collect blood and/or to effect transfusion from a donor to a donee. Low pressure, pulsatile pumps also are useful in kidney dialysis techniques to transfer blood to and from the dialysis machine.

In general, the various pulsation flow systems which have been available utilize intermittent pumping devices of some complexity. Typically the device requires a pump mechanism which is driven by any of a variety of motors. The pump and motor systems may be electrically operated or, in some instances, may be operated in response to the fluid pressure and flow of the fluid which is to be pulsated.

While a number of devices which utilize a pulsatile flow device have enjoyed varying degrees of commercial success, they still are not free from difficulties. For example, they tend to be somewhat cumbersome and are not as portable as would be desired. When the fluid pulsatile device is used in a surgical or operating room environment, it is preferable that it be small, as compact and as light as is reasonably possible. While it would be desirable to have a prepackaged, presterilized disposable device, none has been available to date.

It is among the primary objects of the invention to provide an improved and greatly simplified fluid pulsatile device having embodiments which are operable in response to positive or negative pressure differentials.

SUMMARY OF THE INVENTION

The invention relates to a pulsatile pumping device which is operable under the influence of a positive pneumatic pressure source as well as a device operable under the influence of a negative, or vacuum, source. Both systems utilize a housing having an enclosed flexible, elastic element which divides the interior of the housing into two chambers, including a pumping chamber and a driving chamber. The pumping chamber has an inlet connectable to a source of the fluid to be pumped and an outlet which may be connected to a delivery line. A check valve is provided in the inlet and/or outlet lines to assure unidirectional flow through the pump. The driving chamber is connected to a source of pneumatic pressure or vacuum, depending on whether it is intended to be operated under positive or negative pressure.

The pump utilizes a two-stroke cycle including a filling stroke and an ejection stroke. Application of a pressure differential across the resilient element causes flexure of the resilient element in a first stroke. The device includes a means responsive to movement of the element in the first stroke to abruptly terminate the pressure differential. A biasing force applied to the element causes the element to effect the second of the two strokes. The device includes means to enable the buildup of the pressure differential after the end of the second stroke thereby repeating the pumping cycle of the device.

In the vacuum driven embodiment of the present invention, the device includes an expandable elastic element, preferably in the form of a sleeve, having an inlet end and an outlet end. The sleeve is contained within and extends through a relatively rigid vacuum driving chamber which is connectible to a vacuum source. The vacuum chamber surrounds the elastic sleeve so that when the vacuum is applied to the chamber the sleeve will expand. A check valve is located at each of the inlet and outlet ends of the sleeve to assure that flow through the sleeve will be unidirectional. When vacuum is applied, the reduced pressure surrounding the elastic sleeve causes the sleeve to expand as fluid is drawn in through the inlet through the open inlet check valve.

In an automatically operating embodiment of the vacuum driven invention, expansion of and ingestion of fluid into the elastic sleeve continues until the elastic sleeve has expanded to a predetermined size at which time the expansion of the sleeve triggers a valve which vents the vacuum chamber to the atmosphere. When the vacuum chamber vents, the elastic sleeve contracts, thereby shutting the inlet check valve and forcing the fluid from the elastic sleeve through the outlet check valve and into the delivery line. The resilient collapse of the elastic sleeve also closes or enables closing of the venting valve to enable the suction to begin a new pumping cycle. The vacuum version of the invention may include manually operable means by which the frequency and extent of pumping action can be controlled.

In the embodiment of the invention driven by positive pressure the device includes a housing divided into two compartments by a flexible, resilient element, such as an elastic diaphragm. The diaphragm divides the housing into two chambers including the pumping and the driven chamber. The pumping chamber has inlet and outlet ports which are connected to inlet and outlet lines, the inlet being connected to a supply of fluid to be pumped. A check valve means is provided in the system to assure flow only in a direction from the inlet to the outlet.

The driving chamber also is provided with an inlet port and an outlet port. The inlet port in the driving chamber is connectable to a source of positive pressure, such as an air cylinder or other gas under pressure. The outlet, when open, exhausted to the atmosphere. The device is arranged so that the elastic diaphragm normally closes the outlet port. The diaphragm may be stretched over the outlet in a closing configuration or it may be biased in an outlet-closing configuration by a supplemental spring element.

The pumping action in the positive pressure device is effected by applying pneumatic pressure at the inlet to the driving chamber. The increased pressure in the pneumatic chamber causes flexure and expansion of that portion of the diaphragm which surrounds, but does not seal the outlet port. Expansion of the diaphragm toward the pumping chamber in the first stroke causes a volume of fluid to be ejected out of the pumping chamber. The ejection continues until the expansion of the diaphragm overcomes the bias of the diaphragm against the outlet. At that point the diaphragm abruptly snaps to a configuration opening the outlet port thereby exhaust venting the driving chamber to atmosphere. The outlet port is arranged to define a greater flow area than the inlet so as to provide minimal impedance to flow through the outlet. Once the outlet is opened the pressure across the diaphragm equalizes which enables the diaphragm to return in the secondstroke to its normal position closing the outlet port. During the second stroke motion of the diaphragm the volume of the pumping chamber is re-expanded which ingests an additional volume of fluid from the fluid inlet into the pumping chamber to fill the pumping chamber in readiness for the next oscillation. Means are provided for controlling the frequency and volume of pumping action.

It is among the general objects of the invention to provide pumping devices which develop a pulsatile action.

Another object of the invention is to provide pumping devices of the type described which may be powered by vacuum or by positive pressure.

Another object of the invention is to provide a pulsatile, peristaltic action pump which displays a gentle pumping action and is suited for use in those medical and surgical environments where delicacy of pumping action is among the prime considerations as well as where higher pulsatile forces are desired.

Another object of the invention is to provide pumping devices of the type described which are operable both automatically as well as manually.

Still another object of the invention is to provide a pump of the type described which is of simple, inexpensive construction and which lends itself to disposable use.

DESCRIPTION OF THE DRAWINGS

The foregoing and other objects and advantages of the invention will be appreciated more fully from the following further description thereof, with reference to the accompanying drawings wherein.

DESCRIPTION OF THE ILLUSTRATIVE EMBODIMENTS

Figure 1:
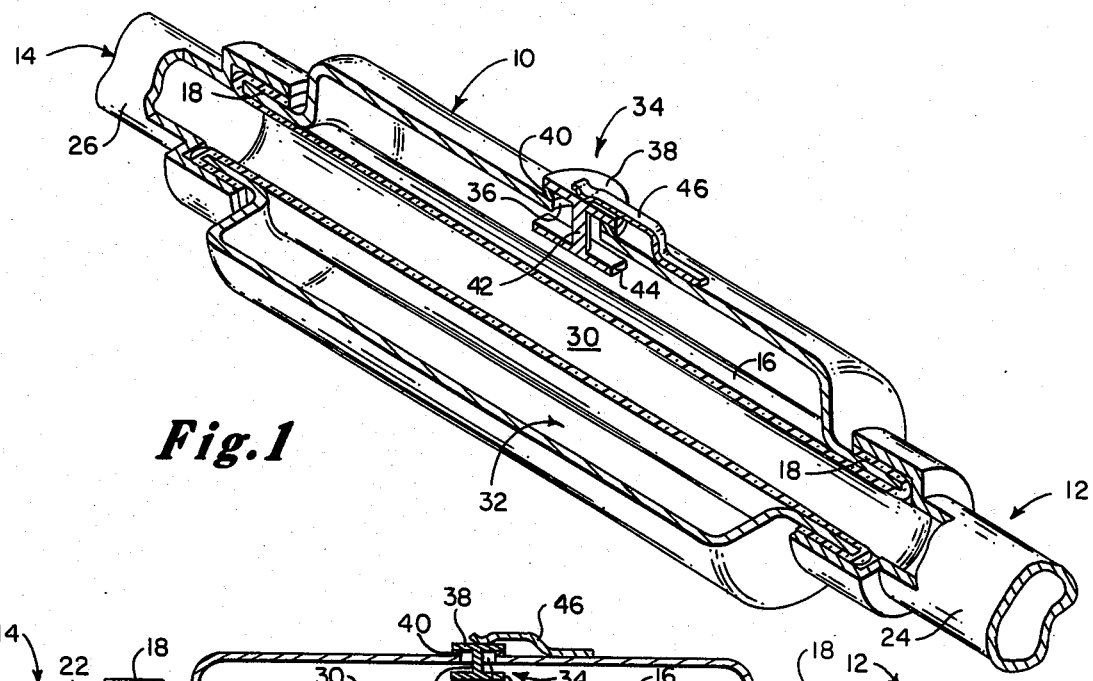
FIG. 1 is a broken-away diagrammatic illustration of a vacuum driven embodiment of the device.

FIG. 1 illustrates, diagrammatically, the functional elements of an automatic vacuum driven embodiment of the device. The device includes a rigid housing 10 which may be molded from plastic or the like. The housing may take any of a variety of shapes, depending in part on the particular environment and manner in which the device is to be used. For example only, the housing may take the form of a conveniently hand-held elongate device or may take the form of a cannister to which various lines, hoses and nozzles may be connected. The housing 10, in the illustrative embodiment includes an inlet end 12 and an outlet end 14. A flexible, resilient member in the form of an elastic sleeve 16 extends through the housing 10 from the inlet end 12 of the housing 10 to the outlet end 14. The ends of the elastic sleeve 16 are hermetically sealed to the inlet and outlet ends of the housing, illustrated diagrammatically by everted ends 18 of the elastic sleeve 16.

A check valve 20, 22 is associated with each of the inlet and outlet ends of the device. The inlet check valve 20 is selected to permit flow only from the inlet 12 into the elastic sleeve 16 and the outlet valve 22 is arranged only to permit flow from the elastic sleeve 16 to the outlet 14. The check valves 20, 22 may be of any convenient design consistent with the intended use of the device. For example, they may be ball check or duck bill valves, mounted in tubing connectors 24, 26 which define the inlet and outlet.

The housing is provided with a fitting 28 which is connectable to a vacuum line which, in turn, may be connected to a vacuum source as is conveniently found in an operating room or other hospital or surgical environment. The vacuum line preferably is provided with a variable restrictor valve (not shown) to shut off or restrict the rate of evacuation from the vacuum chamber of the device.

From the foregoing, it will be appreciated that the interior of the housing 10 may be considered as defining a variable volume pumping chamber 30 (defined by the interior volume of the elastic sleeve 16) and a surrounding or annular vacuum driving chamber 32. In operation, as a vacuum develops in the vacuum chamber 32, the elastic sleeve will expand, ingesting and drawing fluid into the pumping chamber 30 through the inlet tube and the check valve 20. During this mode of operation, the outlet check valve 22 remains closed.

Figure 2:
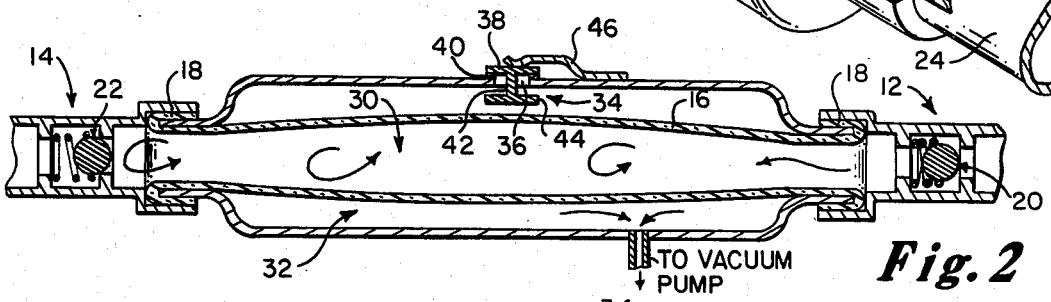
FIG. 2 is a longitudinal section of the vacuum device shown in FIG. 1 illustrating the manner in which the elastic element expands to ingest fluid.
Figure 3:
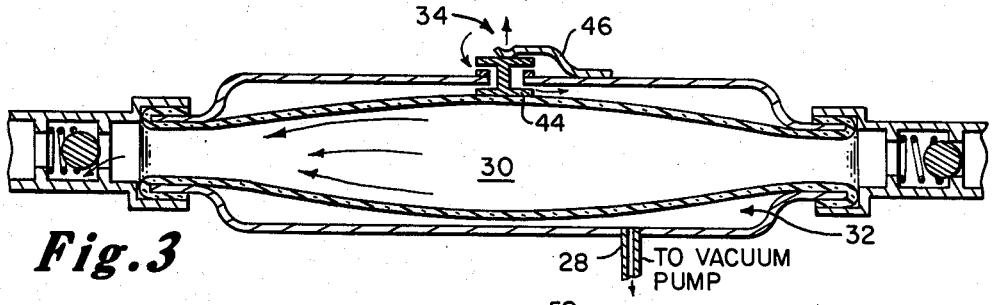
FIG. 3 is an illustration of the vacuum device similar to FIG. 2 diagrammatically illustrating the device when it vents to the atmosphere to effect a pulsatile pumping action of the elastic element.

The volume which will be ingested and pumped by the pump chamber 30 is a direct function of the extent to which the sleeve 16 is permitted to expand. To that end, the device includes a relief valve 34 which is located on the housing 10 so as to be tripped by the transversely expanding sleeve 16 when the pump chamber 32 has reached a predetermined volume. In the diagrammatic illustrative embodiment of the invention, the relief valve 34 is mounted in the chamber housing 10 and extends through a vent opening 36 formed in the housing 10. The valve 34 includes a valve element 38 which is illustrated as being in the form of a pad. The valve element 38 cooperates with a valve seat 40 which surrounds the vent 36. The valve element 38 normally bears against the valve seat 40 to maintain the valve opening 36 closed as shown in FIGS. 1 and 2. The valve arrangement 34 also includes an inwardly extending valve stem 42 which extends inwardly from the valve member 38 through the opening 36. The inner end of the valve stem 42 terminates in a valve pad 44 which is engageable by the transversely expanding elastic sleeve 16. The valve may be biased in its closed, seated relation on the valve seat 40 by a supplemental spring or biasing means, as illustrated diagramatically by the leaf spring 46.

From the foregoing, it will be appreciated that when the elastic pumping chamber 30 has expanded to a predetermined size, it will engage the valve pad 44 and continued expansion of the sleeve will shift the valve 44 to open it and permit atmospheric air to rush in through the valve opening 36. The magnitude of vacuum and the size of the valve opening 36 may be selected so that the rate of admission of air through the valve opening 36 will be sufficiently greater than the rate of air flow through the vacuum line as to enable the elastic sleeve to return to its reduced volume within a predetermined time interval. Thus, by adjusting these parameters, the characteristics, such as frequency, of the pulsatile pump action can be varied.

When the valve opens, the elastic nature of the sleeve causes the sleeve to constrict, thereby forcing fluid contained in the elastic pumping chamber 30, outwardly through the outlet check valve 22 and into the outlet tube 14. When the elastic pump chamber 30 has contracted to an extent at which the relief valve 34 can reclose, the cycle begins anew.

From the foregoing, it will be appreciated that the vacuum driven embodiment of the invention is usable either as a suctioning device or as a fluid delivery device. The device may be used in closed wound suctioning, for example, of the abdominal cavity, in which the inlet 24 may be connected to a conventional closed-wound drainage tube and the level of vacuum in the vacuum line and rate of evacuation from the chamber adjusted to provide the desired suctioning and pumping effect. Alternately, the device could be used as a stomach pump to effect gentle, yet firm peristaltic pumping of material from the patient's stomach. As an output delivery device, the inlet tube may be inserted into a sterile irrigating or debridement solution and the outlet end may be connected to a tube which in turn is provided with a suitable nozzle or shower-like element at its outlet end. The fluid pumping action is suited particularly to those situations where it is important to have a very gentle action and where high speed, more forceful, jets are undesirable, as for example, when the surface of delicate organs or delicate wounds are being cleaned. In this regard, it may be noted that the pumping pressures utilized in the vacuum driven embodiment of the present invention may be relatively low, and typically may be well under one atmosphere. This results from the ability of the device to be operated between a low pressure equal to the maximum vacuum available at the particular source and atmospheric pressure. During operation of the device, the vacuum within the vacuum chamber may be varied between atmospheric and a selected level of vacuum, as desired.

Figure 4:
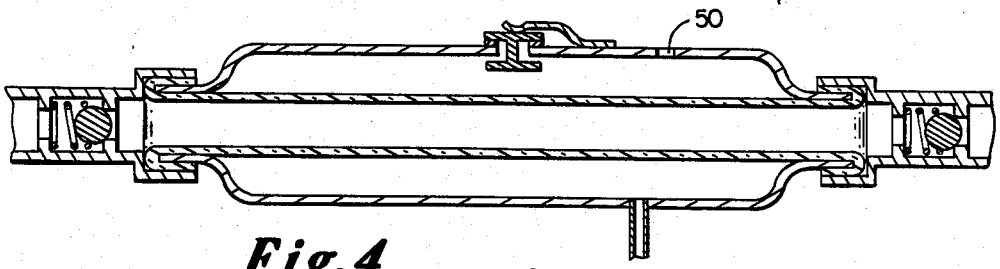
FIG. 4 is an illustration of a modification to the vacuum driven device shown in FIGS. 1–3 by which the automatic venting action can be manually overridden and controlled.

FIG. 4 illustrates a modification to the vacuum driven device in the form of an aperture 50 formed in the housing 10 at a convenient location where it can be covered or uncovered by the user's finger. The provision of the opening 50 in the housing 10 provides the user with a convenient on-off control. The device may be disabled, effectively to an "off" configuration by uncovering the hole 50 thereby continuously venting the chamber 32 to the atmosphere. When it is desired to resume operation of the device, the aperture 50 need only be covered to enable the vacuum to be developed within the chamber 32. In addition to providing an on-off control, the aperture may be selectively blocked or unblocked to vary frequency of operation of the automatic valving arrangement by varying the extent to which the aperture is obstructed. Additionally, the aperture may be covered or uncovered at a rapid rate, faster than the normal, automatic frequency of operation of the device, thereby providing substantially, completely manual mode of operation.

Figure 5:
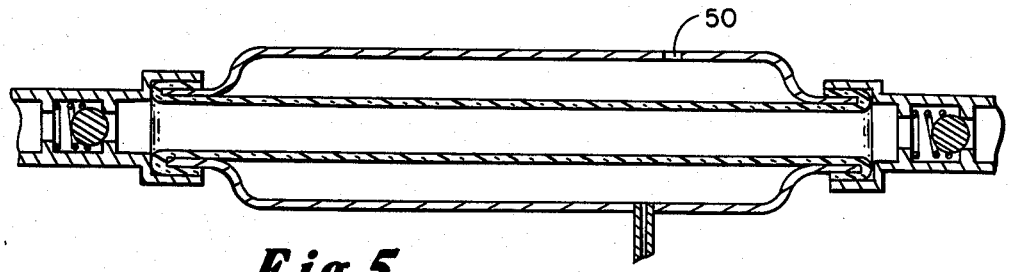
FIG. 5 is an illustration of a completely manually operable embodiment of the vacuum driven device.

In some instances, it may be preferable simply to provide a device which is completely manually operable. FIG. 5 illustrates a device which is essentially the same as that discussed previously except that it completely omits the automatic valving arrangement and, instead, provides simply a manually controllable aperture. Here, the frequency is completely controlled by the user by opening and closing the aperture 50, to an extent and at a rate which suits the particular needs and requirements of the moment.

Figure 6:
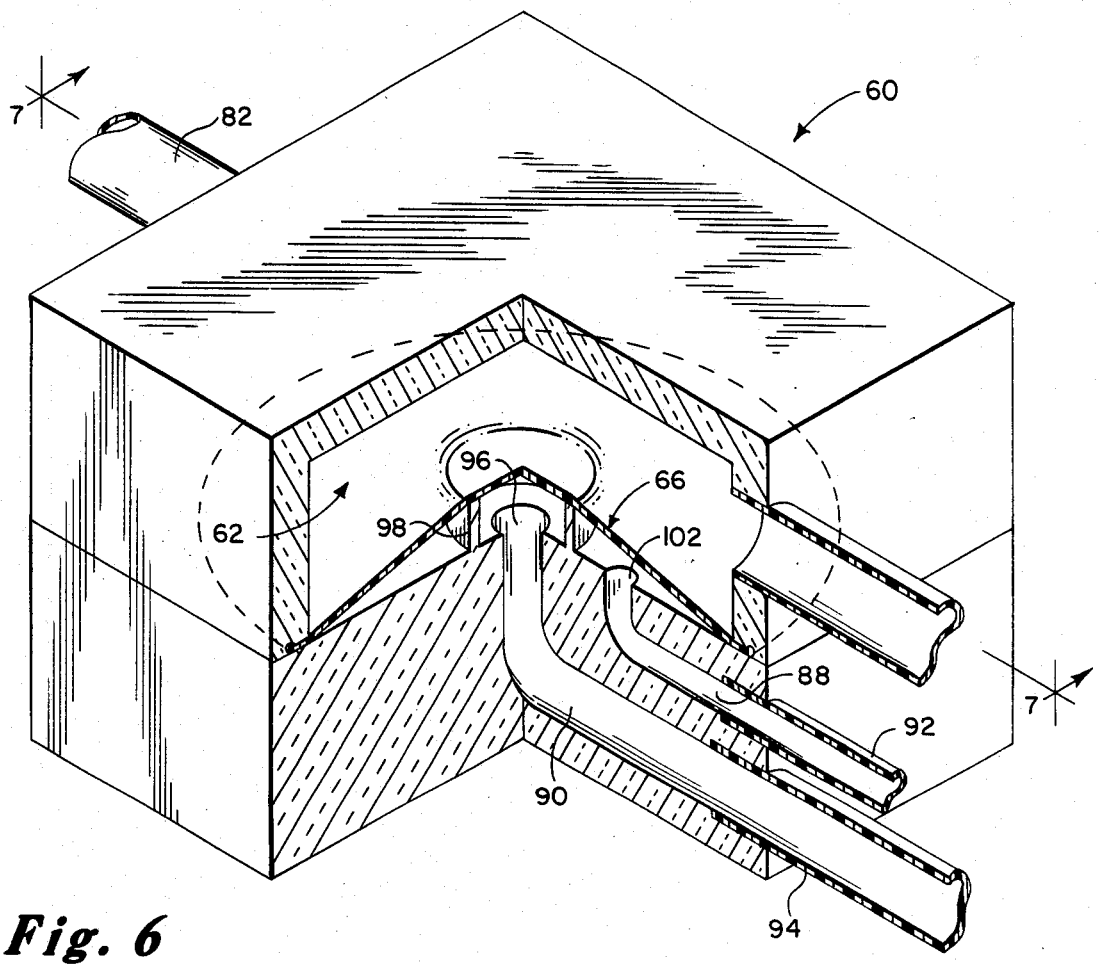
FIG. 6 is a cutaway perspective illustration of an embodiment of the invention which is driven by positive pneumatic pressure.
Figure 7:
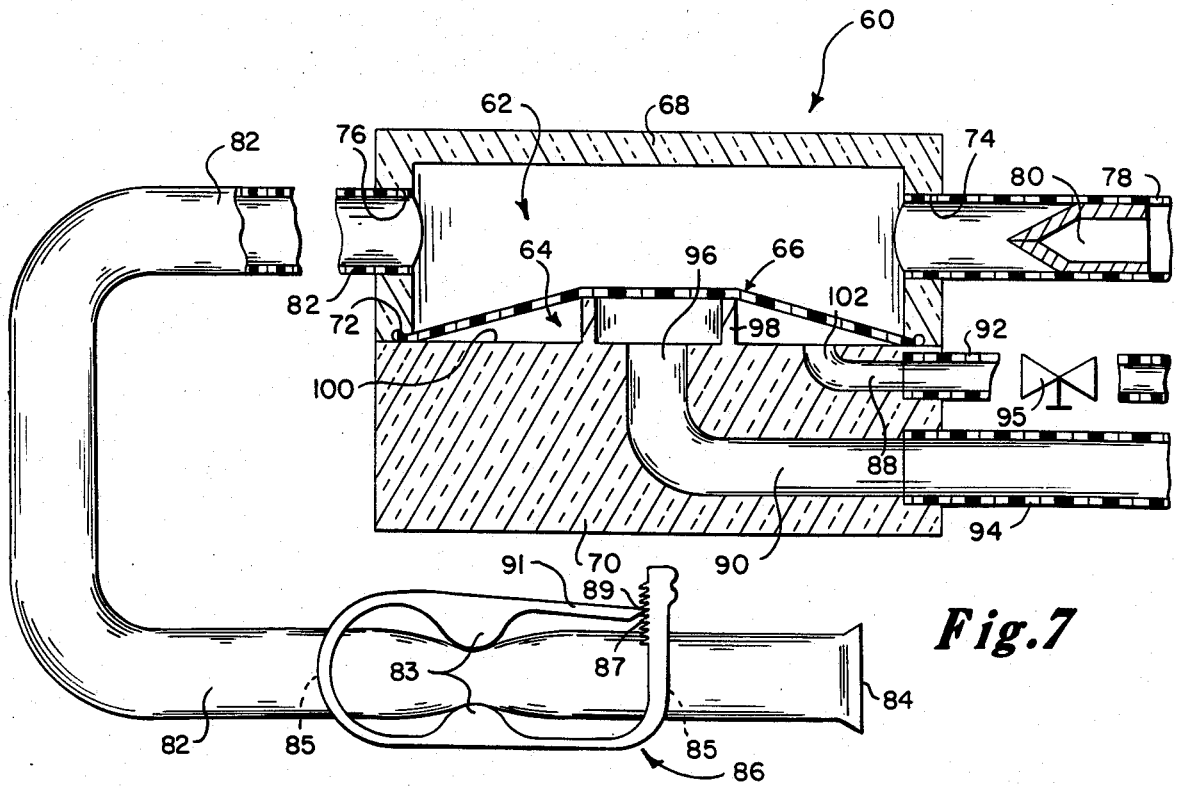
FIG. 7 is a diagrammatic illustration, in section, of an embodiment of the invention which is driven by positive pneumatic pressure, as seen along the lines 7—7 of FIG. 6.

FIGS. 6–9 illustrate, diagrammatically, an embodiment of the invention in which the pump is driven by positive pneumatic pressure. As shown in FIGS. 6 and 7 the device includes a housing 60, the interior of which is divided into a variable volume pumping chamber 62 and a driving chamber 64, the chambers 62, 64 being defined and separated by a flexible, resilient member 66, such as an elastic diaphragm. The housing 60 may be formed in two sections 68, 70. The flexible resilient member 66 preferably is captured between the housing sections 68,70 when the device is assembled. The periphery of the flexible resilient member may be provided with an enlarged rim 72 which can be received in a receptive groove formed in one or both of the sections 68, 70 to cooperatively grip the rim 72. The housing sections 68 and 70, and the periphery of the flexible resilient member 66 are sealed to assure hermetic isolation between the chambers 62, 64 as well as a complete seal to the atmosphere.

The housing 60 includes a fluid inlet 74 and a fluid outlet 76 leading to and from the pumping chamber 62. The inlet 74 is connected by a tube 78 to a source of the fluid which is to be pumped such as, for example, a suitable sterile irrigation solution for use in surgical and debridement of wounds, surgical sites or the like. The device also includes means for maintaining unidirectional flow along the flow path defined by the inlet 74, pumping chamber 62 and outlet 76 and, to that end, a check valve 80 may be placed along the flow path, preferably in the inlet conduit 78. Although an additional check valve may be placed in the outlet line, the manner in which the device operates enables an outlet check valve to be omitted, as will be described.

The outlet 76 of the housing 60 is connected to an outlet tube 82 which may terminate in an outlet nozzle 84. A throttling valve, indicated generally at 86, is interposed along the flow path defined by the outlet tube 82 and nozzle 84. The type of throttling valve may vary with the intended use of the device. The throttling device may take the form of a simple adjustable clamp, as shown in FIG. 7, which is fitted onto the flexible tubing 82. Such a clamp can be located at the nozzle or at a more upstream location along the tube 82 as desired. In other embodiments the throttle valve may take other forms and may be incorporated into a hand held nozzle so as to be operated conveniently by the user. The clamp illustrated in FIG. 6 is a commercially available clamp formed from a unitary plastic defining a pair of compression pads 83 which grip and squeeze the flexible tube 82. The tube extends through apertures 85 formed in the clamp 86. One end of the clamp includes a rachet surface 87 which cooperates with a relatively sharp edge 89 of another leg 91 of the clamp to lock the clamp in any of a variety of positions. The various positions in which the clamp may be locked determine the degree to which the tube 82 is throttled by the pads 83.

The pumping action is effected by oscillations of the elastic diaphragm 66. The device includes a two-stroke mode of operation, including an ejection stroke and a filling stroke. In the ejection stroke diaphragm 66 is caused to flex to decrease the volume of the pumping chamber 62, applying pressure to the fluid in the chamber 62. During the ejection stroke fluid is caused to flow from the pumping chamber 62 through the outlet tube 82 and is dispensed from the nozzle 84. Reverse flow is prevented by the check valve 80. As described below, the ejection stroke is terminated abruptly and in a manner to enable the elastic diaphragm 66 to return to its starting position in which the volume of pumping chamber 62 re-expands to its original volume. The re-expansion of the member 66 defines the filling stroke and causes fluid to be drawn from the fluid source through the inlet tube 78 and check valve 80 to the pumping chamber 62, in readiness for the next pumping stroke.

The flexible, resilient member 66 is constructed and mounted in the housing 60 so that it can oscillate under the influence of positive pneumatic pressure applied to the driving chamber. To that end the device includes an air inlet passage 88 and air outlet passage 90. Inlet passage 88 is connected to a source of air or other appropriate gas under pressure by an air inlet tube 92. Exhaust from the air outlet passage 90 may be communicated from the driving chamber by an exhaust tube 94. The air exhaust passage 90 leads from an exhaust port 96 which, in the illustrative embodiment, is located in registry with the center of the elastic element 66. Exhaust port 96 is arranged to communicate with the driving chamber 64. The diaphragm 66 is normally biased toward the exhaust port 96 so as to seal off the exhaust port from the driving chamber 64. In the embodiment illustrated in FIGS. 6–9 the bias is accomplished by the elasticity of the diaphragm 66 and by providing a bearing member such as an upstanding wall 98 which surrounds the exhaust port 96 and over which the elastic diaphragm 66 is stretched. In this configuration of the device the height and location of the wall 98 is selected with respect to the manner in which the peripheral rim 72 of the diaphragm 66 is held in place. In the embodiment shown, the elastic diaphragm 66 is stretched into a dome shape and is maintained under an elastic tension which biases the diaphragm 66 toward the exhaust port 96 to close the port 96. Thus, in the embodiment shown in FIGS. 6–9 the driving chamber 64 may be considered as somewhat annularly shaped, being bounded by the wall 98, the surface of the elastic diaphragm 66 and the surface 100 of housing section 70. The air inlet passage 88 communicates with the driving chamber 64 at an air inlet port 102 which opens through the wall surface 100 of the housing section 70.

Figure 8:
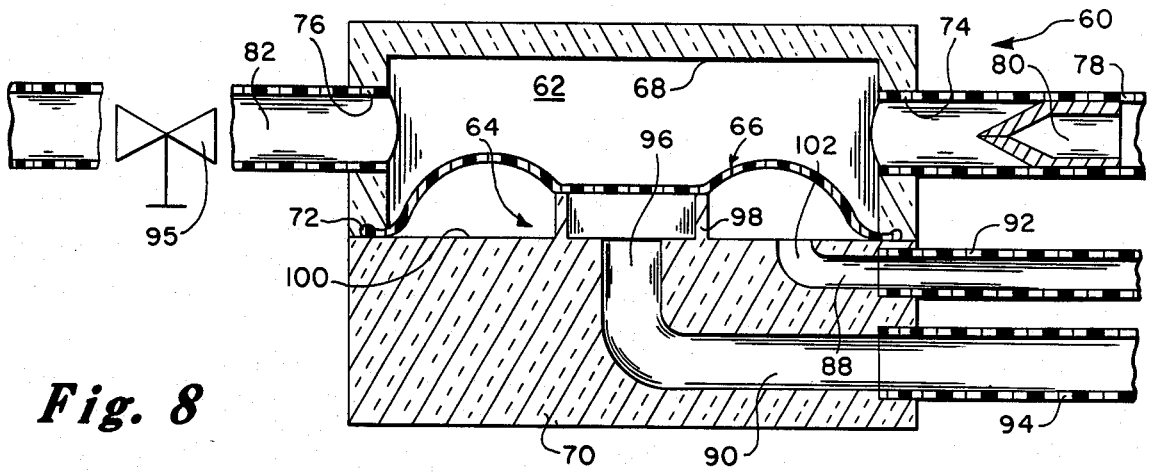
FIG. 8 is an illustration similar to FIG. 6 showing the resilient element distended near the conclusion of the ejection stroke.
Figure 9:
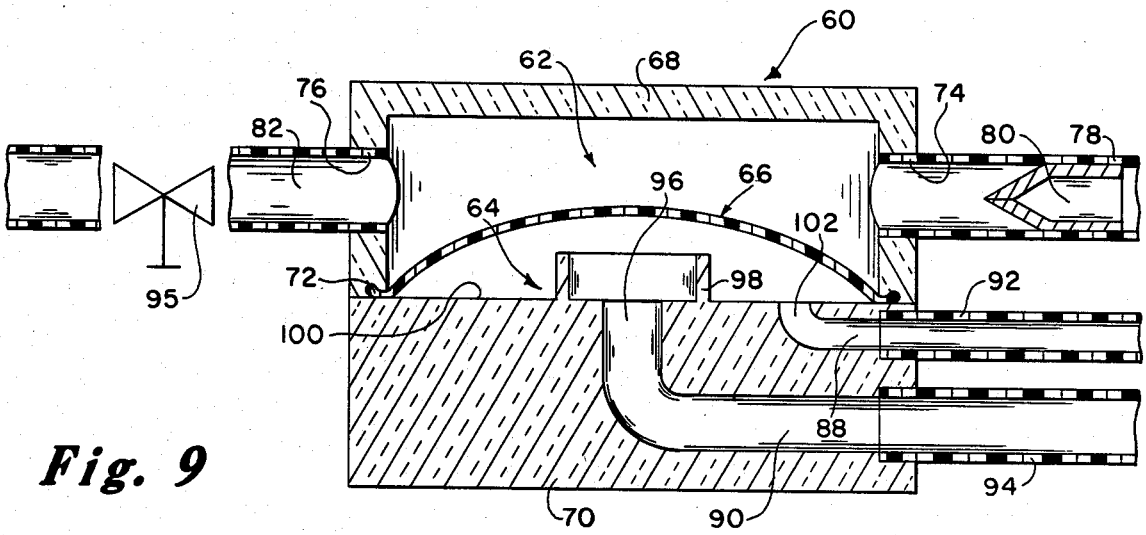
FIG. 9 is an illustration of the device is FIG. 6 illustrating, diagrammatically, the configuration of the pump as it shifts from the ejection stroke to the filling stroke.

The operation of the foregoing embodiment is illustrated with further reference to FIGS. 8 and 9. The system first is primed so that fluid to be pumped completely fills the flow path from the reservoir, through the inlet tube 78, pump chamber 62 and outlet 82, 84. Priming is accomplished easily by opening the throttle valve 86 and allowing the liquid to flow, by gravity or under light pressure through the system. Once primed the throttle valve is closed in readiness for pumping operation. In the ejection stroke of the cycle pneumatic pressure is applied at air inlet tube 92. As the pressure builds up within the driving chamber 64 the elastic diaphragm 66 expands to form a domed annular configuration suggested diagrammatically in FIG. 8 in some exaggeration for purposes of clarity of illustration. The pressure built up within the driving chamber 64 is applied, through the diaphgram, to the fluid in the pumping chamber 62 thereby ejecting fluid through the outlet 76. The volume of fluid pumped in the ejection stroke is equal to the difference in volume in the driving chamber from its relaxed (FIG. 6) position to its position of maximum expansion (FIG. 8). The maximum expansion, as well as the force in the ejection stroke can be controlled and varied as will be described further below.

The ejection stroke continues as long as the flexible resilient element remains biased in sealed relation against the exhaust port 96. In the embodiment shown in FIGS. 6-9, in which the member 66 is an elastic diaphragm, biasing force is created by the inherent elasticity of the diaphragm and the manner in which it is stretched over the rim of the wall 98 which surrounds and defines the exhaust port 96. The central portion of the diaphragm which makes the seal against the rim of the wall 98 maintains that seal until the remaining portion of the diaphragm 66 has been flexed and expanded to a point in which the opening force applied to the central portion of the diaphragm by the expanding peripheral portions of the diaphragm exceeds the biasing force. The central portion of the diaphragm is maintained in seated sealed relation against the rim of the wall 98 not only under the influence of the bias of the elastic diaphragm but also under the influence of a pulse of increased pressure applied to the fluid in the pumping chamber. Thus, as the diaphragm expands into the annular dome-shaped configuration illustrated in FIG. 8 the pressure pulse applied to the liquid in the pumping chamber forces the central portion of the diaphragm more firmly into seated engagement on the rim of the wall 98. That additional pressure enables the diaphragm to expand to the annular domed configuration shown in FIG. 8, in which the central portion of the diaphragm remains depressed, in a dimpled configuration with respect to the annular expanding portion of the diaphragm during a portion of the ejection stroke. In this regard it should be noted that the impedance in the outlet line also has an effect on the timing of the unseating of the diaphragm from the air outlet port. The impedance of the outlet should be great enough to allow sufficient pressure to build up within the pumping chamber so as to maintain the central portion of the diaphragm in sealing engagement on the outlet port for a time sufficient to enable a desired volume of liquid to be pumped during the pumping stroke. As the ejection stroke nears completion the stretched diaphragm abruptly unseats the central portion of the diaphragm from its sealing engagement with the rim of the wall 98.

At the moment that the sealed, central portion of the diaphragm abruptly unseats from the rim of the wall 98 the elastic diaphragm immediately assumes a more uniform dome shape as suggested in FIG. 9 under the influence of the equalization of the internal elastic forces in the diaphragm. The internal elastic forces within the diaphragm 66 cause the diaphragm to contract which draws the diaphragm down into sealing engagement with the rim of the wall 98.

During the elastic contraction of the diaphragm the air which was in the driving chamber 64 is exhausted immediately and rapidly through exhaust port 96, air outlet passage 90 and exhaust tube 94. The immediate and rapid exhaust from the driving chamber 64 is assured by providing substantially larger outlet passages than those associated with the air inlet. Thus, outlet port 96, air outlet passage 90 and exhaust tube 94 are arranged so as to prevent a minimum of back pressure which might impede rapid exhaust of air from the driving chamber.

In order to assure that the diaphragm will collapse rapidly it is important that the impedance in the air outlet line is substantially less than that in the air inlet. This may be accomplished by selectively proportioning the flow areas of the air inlet and air outlet. If desired, a fixed or variable flow restrictor (suggested diagrammatically at 95 in FIG. 7) can be placed at the air inlet. Use of a flow restriction device 95 at the air inlet also prevents development in the driving chamber of too high pressures and inlet flow rates which could stall the diaphragm in the open, domed configuration. The flow impedance in the fluid line 82 outlet should be greater than the flow impedance at the fluid inlet 74, including the effect of the inlet check valve 80.

As mentioned above it is not necessary to use a check valve in the fluid outlet. During the filling stroke, the contraction of the diaphragm reduces the pressure in the pumping chamber. Fluid is drawn in through the inlet 74 and check valve 80 at the inlet. Although there is no check valve in the outlet line the filling stroke does not draw liquid back into the pump chamber. That is believed to result from the inertial effect of the liquid flowing through the outlet during the pumping stroke. When the diaphragm abruptly unseats and substantially immediately begins to contract in a filling stroke, the action is too abrupt to decelerate and reverse the flow of the liquid flowing in the outlet tube. Additionally the inertial effect of the water in the outlet tube is affected by the length of the outlet tube as well as the impedance of the inlet check valve. The length of the outlet tube preferably should be great enough to present a substantial impedance to reverse flow. A tube at least one foot long and as long as about eight feet or more is satisfactory.

The throttling control 86 affects the frequency of pulsation as well as the pulse strength (the velocity of the emitted fluid jet). As the throttle valve is opened the frequency of the pulses increases and the velocity of the pulses increases.

Operation of the device is controlled manually by the user by controlling the throttle valve 86. When the valve is closed there is no flow through the system. As the valve is opened, the resulting differential pressure across the diaphragm initiates the pumping cycle. The cycle will repeat automatically and continuously as long as the throttle valve remains open. The delivery rate, exit velocity and pulse frequency increase from zero when the valve is fully closed to progressively higher values as the valve is fully opened.

An alternative mode of control can be achieved by regulating the air pressure at the inlet, as by a suitable throttling valve in the inlet line.

Figure 10:
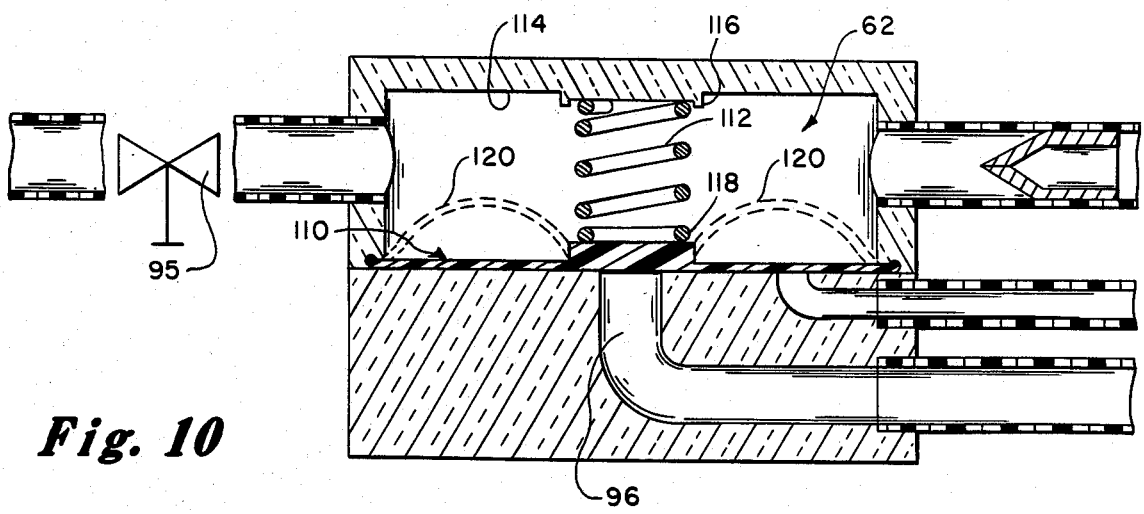
FIGS. 10 and 11 are sectional illustrations of a modified form of the positive pressure driven device.
Figure 11:
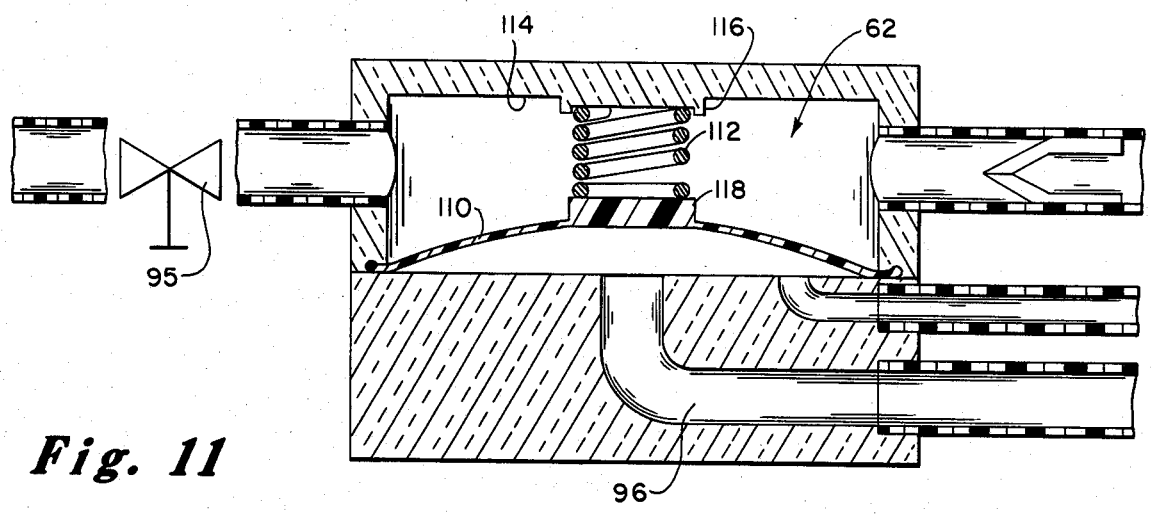

FIGS. 10 and 11 illustrate an alternate embodiment of the positive pressure operated device. In this embodiment the elastic diaphragm 110 is additionally biased toward closing the exhaust port 96' by a compression spring 112. The compression spring 112 extends across the pump chamber 62 and is restrained at its upper end against the roof 114 by a socket 116 receptive to an end of the spring 112. The other end of the spring 112 bears against that portion of the diaphragm 110 which overlies the exhaust port 96. In this embodiment the portion of the diaphragm 110 which overlies the exhaust port 96 may be thickened, as shown at 118, to provide bearing support for the spring 112. The force of the spring and the flexible resilient character of the diaphragm 110 are selected so that the annular portion of the diaphragm, surrounding its central portion can expand as illustrated diagrammatically (and in exaggerated detail) in phantom in FIG. 10 at 120. The parameters of the spring and diaphragm are selected so that the spring 112 will maintain the exit port 96 closed until a sufficient volume of fluid has been pumped from the pumping chamber 62. When the biasing force of the spring 112 is overcome the central pad portion 118 of the diaphragm breaks its seal at the exhaust port 96 thereby initiating rapid exhaust of air under pressure from the driving chamber 64. When the exhaust port is opened the diaphragm assumes the configuration illustrated diagrammatically in FIG. 11. Thereafter the biasing effect tends to return the diaphragm to its starting configuration illustrated in solid in FIG. 10 and the device is ready for its next oscillatory cycle. It may be noted that in the embodiment illustrated in FIGS. 10 and 11 the addition of the biasing compression spring 112 may result in omission of the raised wall 98 of the previous embodiment. In this embodiment the diaphragm is not preliminarily stretched as is the case with the previously described embodiment. The control and operation of the embodiment illustrated in FIGS. 10 and 11 is otherwise substantially the same.

Figure 12:
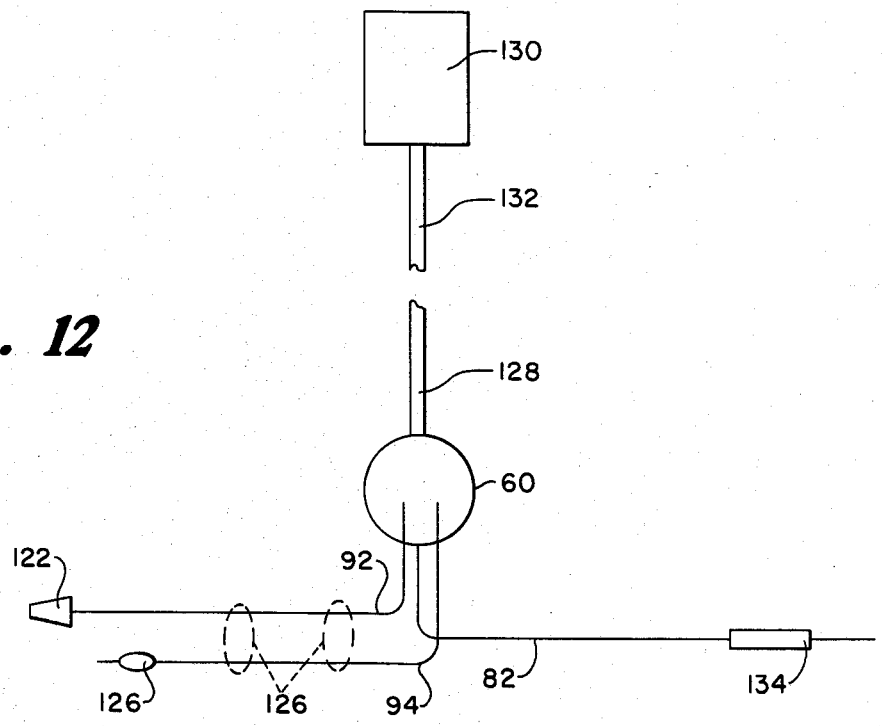
FIG. 12 is a diagrammatic illustration of the manner in which a pump in accordance with the invention may be used in surgical irrigation or debridement system.
Figure 13:
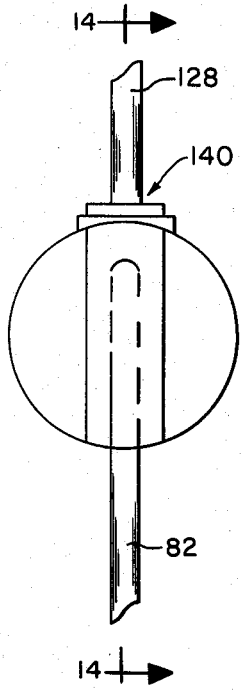
FIG. 13 is a side elevation of a pump adapted for quick connection and disconnection to a source of irrigation solution, such as might be employed in a system of the type shown in FIG. 12.
Figure 14:
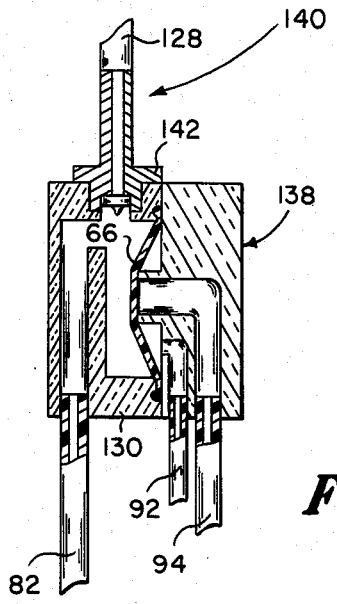
FIG. 14 is a sectional elevation of the pump as seen along the line 14—14 of FIG. 13.
Figure 15:
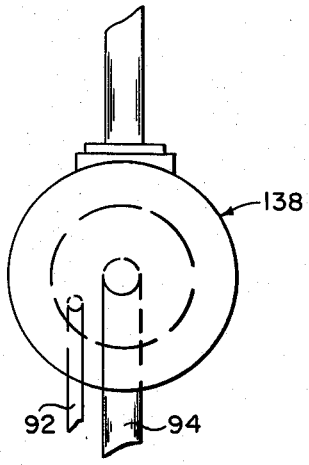
FIG. 15 is a side elevation of the pump shown in FIG. 13 as seen from the right side thereof.
Figure 16:
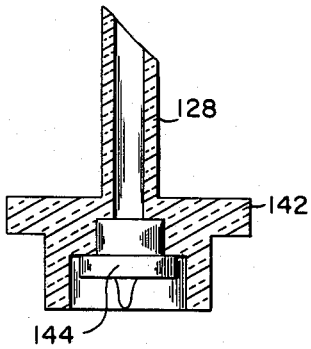
FIG. 16 is an enlarged sectional illustration of the connection needle and integral check valve illustrated in FIG. 14.
Figure 17:
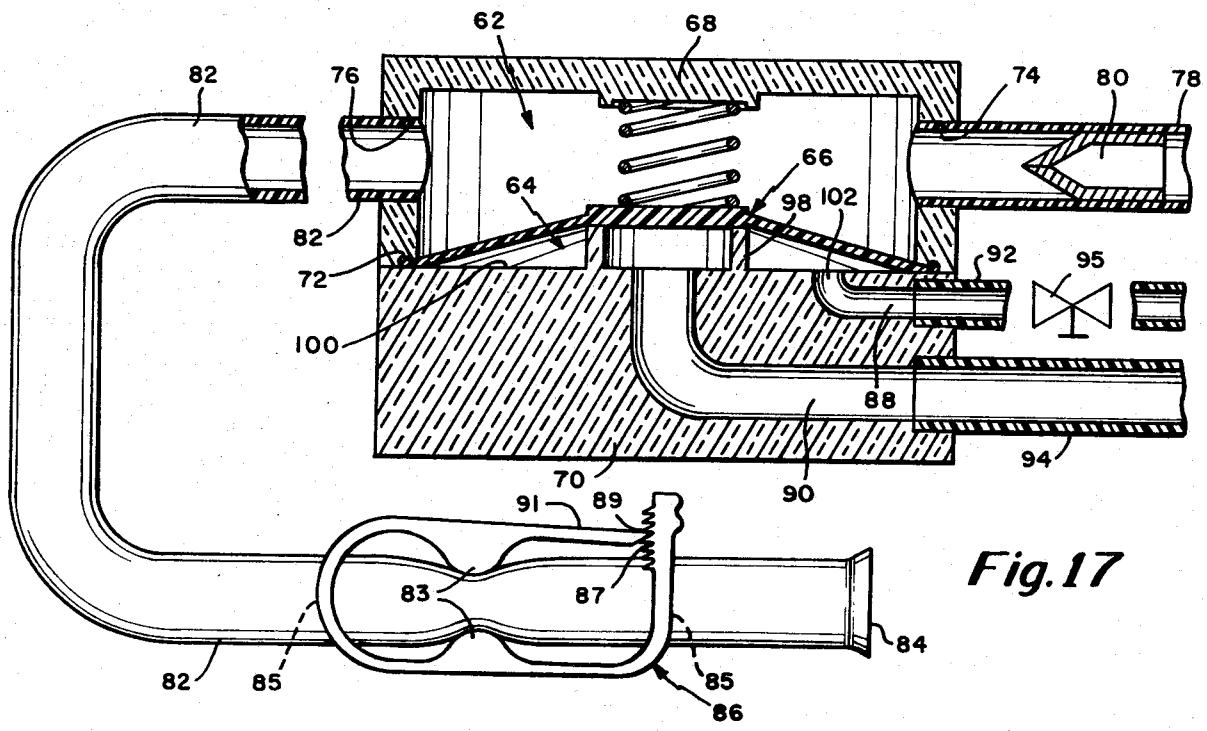
FIG. 17 is an illustration of the embodiment of FIGS. 6–9 having a supplemental spring which additionally biases the elastic member toward a closed position.

FIG. 12 illustrates the manner in which a device in accordance with the invention may be incorporated into a fluid delivery system, for example as may be used in an operating room to clean wounds, for debridement or to clear away bone chips or fragments as is common in orthopedic surgical procedures. The system includes the pump, indicated generally at 60. The pump 60 is connected to the air inlet tube 92 which may have a fitting 122 at its end for connection to an appropriate source of air or gas under pressure. The pump 60 also has an air outlet tube 94 connected as described above. The air outlet tube 82 may be provided with a muffler chamber 126. The air outlet and inlet tubes 82, 94 may be bound together in a common harness as suggested at 126. The fluid outlet tube 82 is connected to the pump 60 in the manner described above. In this embodiment the inlet to the pump 60 may take the form of a hollow needle 128 which is adapted to pierce or otherwise connect with the bottle or other prepackaged reservoir of fluid to be pumped, indicated at 130 in FIG. 12. The reservoir of 130 preferably may have a connector or puncturable neck indicated at 132 to receive the needle 128 and establish communication between the reservoir 130 and the pump inlet. The reservoir 130 may be suspended overhead to facilitate priming of the device under the influence of gravity by opening the throttle valve. The throttle valve preferably is incorporated into a handle 134 at the distal end of the outlet tube 82.

The device conveniently may be associated with a suction system for suctioning fluid away from the surgical site by mounting or incorporating the nozzle with a suction handle, thereby providing irrigating fluid and suction in a single composite device.

FIGS. 13–16 illustrate, somewhat diagrammatically, a pump having an integral needle 128 as may be used in a system described in connection with FIG. 12. In this embodiment the pump housing has two sections including a pump section 136 and a pneumatic driving section 138. As with the previously described embodiments, the pump section 136 and pneumatic drive section 138 are secured together and in a manner which captures the periphery of the flexible resilient element 66. In the embodiment shown in FIG. 14 the pneumatic drive section includes the air inlet tube 92 and air outlet tube 94 which operated in the manner as described above. The pump includes an outlet tube 82 which similarly operates in the manner described above in connection with the previous embodiments. The inlet to the pump section may include a fitting, indicated at 140 shown in greater detail in FIG. 16. Fitting 140 is formed from an appropriate material and includes a hollow needle 128. The needle 128 may be formed integrally with a hub 142 secured to the pump section 136. The hub 142 may include a one-way check valve 144. Check valve 144 may take any of a variety of well-known configurations such as a duckbill or flat valve.

It should be understood that while the foregoing description of the invention is intended to be diagrammatic and illustrative only, other embodiments, modifications and uses may be apparent to those skilled in the art without departing from its spirit.

Having thus described the invention, what I desire to claim and secure by Letters Patent is:

1. A pulsatile pump operable to develop two strokes including a filling stroke and an ejection stroke, said pump comprising:

a housing;

an elastic member within the housing arranged to divide the interior of the housing into a pumping chamber and a driving chamber;

the pumping chamber having an inlet and an outlet, said inlet pumping chamber and outlet defining a flow path for fluid to be pumped;

check valve means for effecting unidirectional flow along the flow path;

said driving chamber having an air inlet and an air outlet;

the air outlet being surrounded by an upstanding wall extending interiorally into the driving chamber, the upper end of the upstanding wall defining a rim about the air outlet;

said elastic member being mounted within the housing so that the elastic member is stretched downwardly over the rim of the upstanding wall thereby effecting a seal against the rim of the upstanding wall, the elastic member being stretched into sealed engagement with the rim and thereby being biased in sealed relation against the rim;

the air inlet communicating with the driving chamber.

2. A pulsatile pump as defined in claim 1 further comprising:

supplemental spring means constructed and arranged to urge a portion of the elastic member into sealed relation against the rim.

3. A pump as defined in claim 1 further comprising variable flow restrictor means for varying the flow rate at the air inlet.

4. A pump as defined in claim 1 further comprising:

means for throttling the outlet from the pumping chamber thereby to control the pulse frequency and outlet velocity of fluid pumped from the pumping chamber.

5. A pump as defined in claim 1 further comprising:

said check valve means being located at least at the inlet to the pumping chamber.

6. A pump as defined in claim 1 further comprising:

said check valve means being disposed in communication with each of the inlet and outlet of the pumping chamber.

7. A pump as defined in claim 1 further comprising:

said check valve means comprising a check valve at the inlet to the pumping chamber;

the outlet from the pumping chamber including an outlet tube, the outlet tube being sufficiently long so that it may contain a volume of fluid large enough so that when the elastic member begins the filling stroke, the inertial effect of the mass of fluid in the outlet tube will be great enough to prevent reverse flow of fluid in the outlet tube during the filling stroke, whereby the pumping chamber will fill with fluid from the inlet to the pumping chamber, the check valve at the inlet having a lower impedance than that defined by the elongate outlet tube.

8. A pump as defined in claim 1 further comprising: means for connecting the inlet of the pumping chamber to a source of fluid to be pumped, said connecting means comprising a connector tube connected to the pump chamber inlet, the connector tube being adapted to be connected to a source of fluid to be pumped.

9. A pump as defined in claim 8 further comprising: said connector tube comprising a hollow needle adapted to pierce a container reservoir of the fluid to be pumped.

* * * * *